US011126126B2

(12) United States Patent
Zaitsu

(10) Patent No.: US 11,126,126 B2
(45) Date of Patent: Sep. 21, 2021

(54) IMAGE FORMING APPARATUS THAT DETERMINES IMAGE FAILURE

(71) Applicant: CANON KABUSHIKI KAISHA, Tokyo (JP)

(72) Inventor: Yoshitaka Zaitsu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/924,454

(22) Filed: Jul. 9, 2020

(65) Prior Publication Data

US 2021/0018869 A1 Jan. 21, 2021

(30) Foreign Application Priority Data

Jul. 19, 2019 (JP) ..... JP2019-134014
Dec. 16, 2019 (JP) ..... 2019-226807

(51) Int. Cl.
*G03G 15/00* (2006.01)

(52) U.S. Cl.
CPC ..... *G03G 15/55* (2013.01)

(58) Field of Classification Search
CPC ..... G03G 15/55; G03G 2215/00738; G03G 15/00742; G03G 15/00751; G03G 15/00759; G03G 15/5029; H04N 1/00026–00092
See application file for complete search history.

(56) References Cited

U.S. PATENT DOCUMENTS 6,038,413 A * 3/2000 Otani ..... G03G 15/5037 399/72
2005/0233239 A1* 10/2005 Fujiwara ..... G03G 9/10 430/111.33
2009/0003857 A1 1/2009 Kuramochi et al.
2011/0219219 A1 9/2011 Adachi et al.
2018/0031985 A1* 2/2018 Nishida ..... G03G 15/75
2019/0171153 A1 6/2019 Ohta et al.
2020/0016907 A1* 1/2020 Ogushi ..... B41J 29/38

FOREIGN PATENT DOCUMENTS

JP 2009-029622 A 2/2009
JP 2010-122787 A 6/2010
JP 2018-017959 A 2/2018
JP 2019-171726 A 10/2019

* cited by examiner

*Primary Examiner* — Carla J Therrien
(74) *Attorney, Agent, or Firm* — Venable LLP

(57) ABSTRACT

An image forming apparatus includes an image forming unit configured to form an image on a sheet; a detection unit configured to detect a characteristic value of the sheet; a reading unit configured to optically read the sheet; and a control unit configured to perform determination processing for determining whether or not an image failure has occurred, by comparing a determination value acquired by causing the reading unit to read a non-image area of the sheet after an image has been formed on the sheet, with a reference determination value that is based on the characteristic value detected by the detection unit.

19 Claims, 6 Drawing Sheets

| REFERENCE DETERMINATION VALUE (UPPER ROW: TYPE LOWER ROW: WHITENESS) | | CHANGE AMOUNT OF REFLECTED LIGHT INTENSITY | | |
|---|---|---|---|---|
| | | ~0.5 | 0.5~0.75 | 0.75~ |
| ULTRASONIC TRANSMISSION SIGNAL INTENSITY | ~0.25 | THICK PAPER 76 | THICK PAPER 84 | GLOSSY PAPER 94 |
| | 0.25~0.5 | THICK PAPER 74 | THICK PAPER 82 | GLOSSY PAPER 92 |
| | 0.5~0.75 | RECYCLED PAPER 74 | PLAIN PAPER 82 | PLAIN PAPER 90 |
| | 0.75~ | RECYCLED PAPER 72 | THIN PAPER 80 | PLAIN PAPER 88 |

IMAGE FORMING APPARATUS THAT DETERMINES IMAGE FAILURE

BACKGROUND OF THE INVENTION

Field of the Invention

The present invention relates to image forming apparatuses such as multifunction machines and printers, and relates particularly to a technique for detecting an image failure.

Description of the Related Art

US-2019-171153 discloses an image forming apparatus in which an image is formed on a sheet, the sheet is then conveyed to a circulative conveyance path, and an image failure is detected by reading a surface of the sheet in the circulative conveyance path. US-2009-003857 discloses an image forming apparatus that has a determination unit for determining the type of sheet.

In an image forming apparatus, an image failure called fog may occur. "Fog" refers to a phenomenon in which a substantially uniform concentration of toner is attached to an entire sheet. Fog may occur if development conditions are not appropriate during development using toner. To detect the occurrence of fog, the base color of a sheet before printing needs to be compared with the color in a non-image area (margin area) of this sheet after printing. Accordingly, to detect fog in the configuration described in US-2019-171153, it is necessary to convey a sheet to the circulative conveyance path and read the base color of the sheet before the sheet is printed, resulting in an increased print time.

SUMMARY OF THE INVENTION

According to an aspect of the present invention, an image forming apparatus includes: an image forming unit configured to form an image on a sheet; a detection unit configured to detect a characteristic value of the sheet; a reading unit configured to optically read the sheet; and a control unit configured to perform determination processing for determining whether or not an image failure has occurred, by comparing a determination value acquired by causing the reading unit to read a non-image area of the sheet after an image has been formed on the sheet, with a reference determination value that is based on the characteristic value detected by the detection unit.

Further features of the present invention will become apparent from the following description of exemplary embodiments with reference to the attached drawings.

DESCRIPTION OF THE EMBODIMENTS

Figure 1:
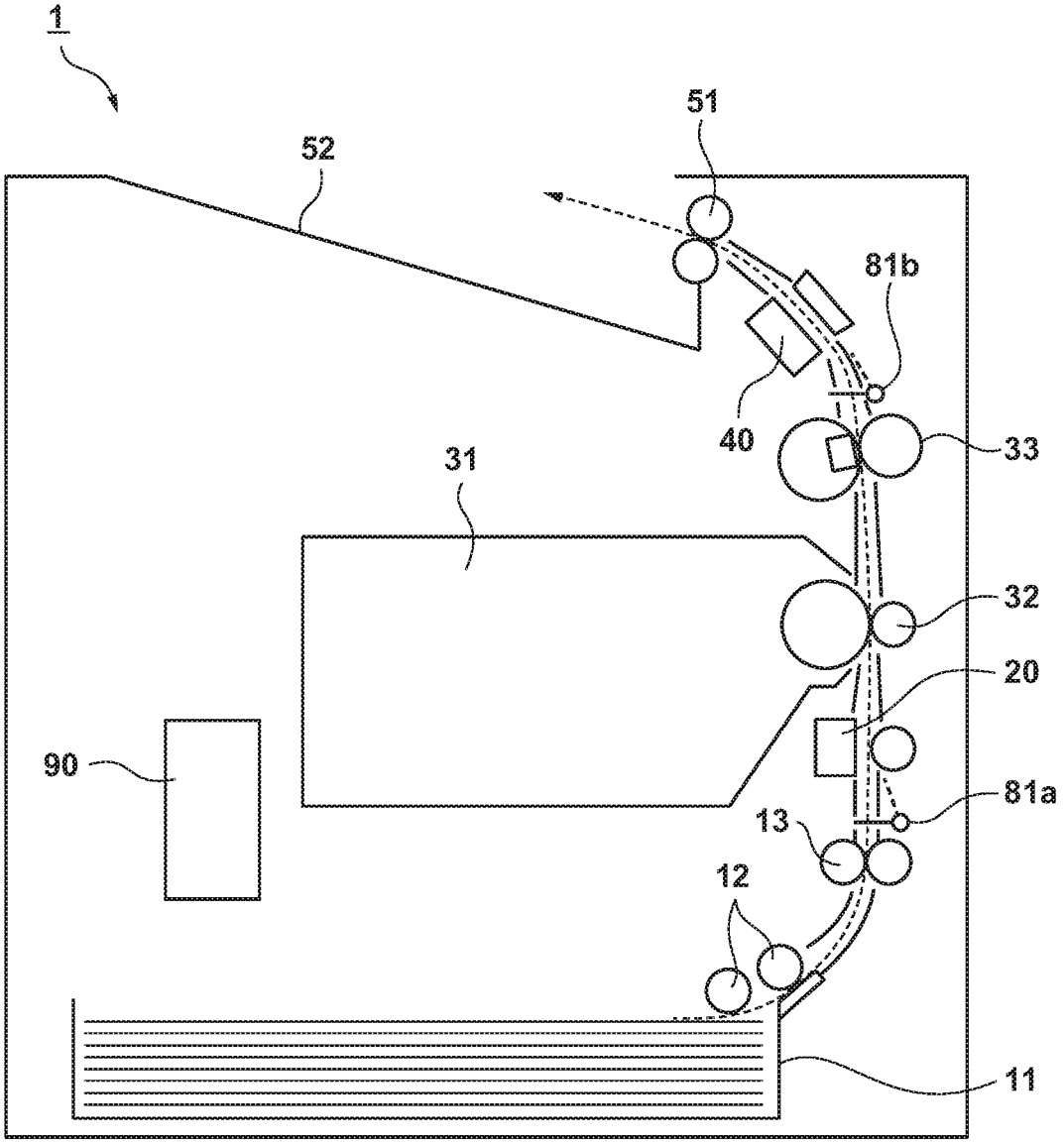
FIG. 1 is a diagram showing a configuration of an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

First Embodiment

FIG. 1 is a diagram showing a configuration of an image forming apparatus 1 according to this embodiment. A sheet contained in a cassette 11, which is a sheet storing unit, is fed to a sheet conveyance path by feed rollers 12, and is conveyed to a downstream side by a roller 13. An image forming unit 31 forms a toner image that is to be transferred to a sheet. A transfer roller 32 outputs a transfer bias voltage and thus transfers the toner image formed by the image forming unit 31 to the sheet. The sheet with the toner image transferred thereto is conveyed to a fixing unit 33. The fixing unit 33 fixes the toner image to the sheet. Then, the sheet is discharged to a tray 52 by a discharge roller 51. Sensors 81*a* and 81*b* for detecting the sheet are provided in the conveyance path. A determination unit 20 detects characteristics of the sheet before the toner image is transferred to the sheet. After the toner image has been fixed to the sheet, a reading unit 40 optically reads a surface of the sheet and outputs image information regarding the surface. Note that, in this embodiment, the reading unit 40 reads the surface of the sheet that is being conveyed through the conveyance path between the fixing unit 33 and a discharge port for discharging the sheet from the image forming apparatus. However, a configuration may alternatively be employed in which the reading unit 40 is configured to be provided between the image forming unit 31 and the fixing unit 33. A control unit 90 controls the image forming apparatus 1.

Figure 2:
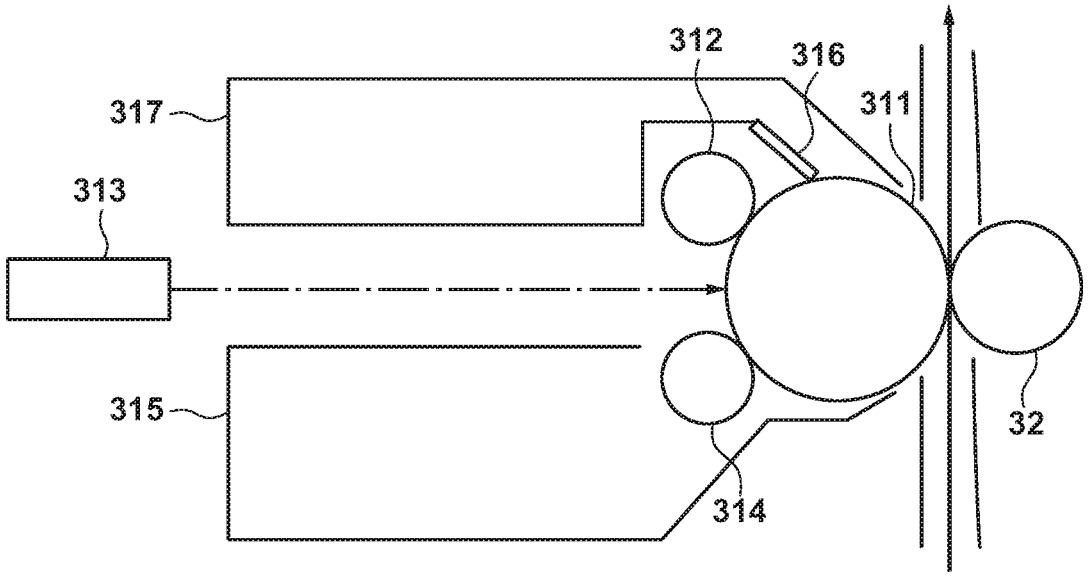
FIG. 2 is a diagram showing a configuration of an image forming unit according to an embodiment.

FIG. 2 is a diagram showing a configuration of the image forming unit 31. A photoreceptor drum 311, which is an image carrier, is driven to rotate in a counterclockwise direction in the diagram when an image is formed. A charging roller 312 charges the photoreceptor drum 311 at a uniform potential. An exposure unit 313 exposes the charged photoreceptor drum 311 and forms an electrostatic latent image on the photoreceptor drum 311. A developing roller 314 in a development unit outputs a development bias voltage, and develops the electrostatic latent image by attaching toner in a toner box 315 to the electrostatic latent image on the photoreceptor drum 311. A cleaning blade 316 collects toner that has not been transferred to the sheet but remains on the photoreceptor drum 311 into a box 317. Note that the developing roller 314 may be set to a close state of approaching the photoreceptor drum 311 and a separate state of being spaced apart from the photoreceptor drum 311 by a predetermined distance. The predetermined distance is greater than the distance between the developing roller 314 and the photoreceptor drum 311 in the close state. FIG. 2 shows the developing roller 314 in the close state.

Figure 3:
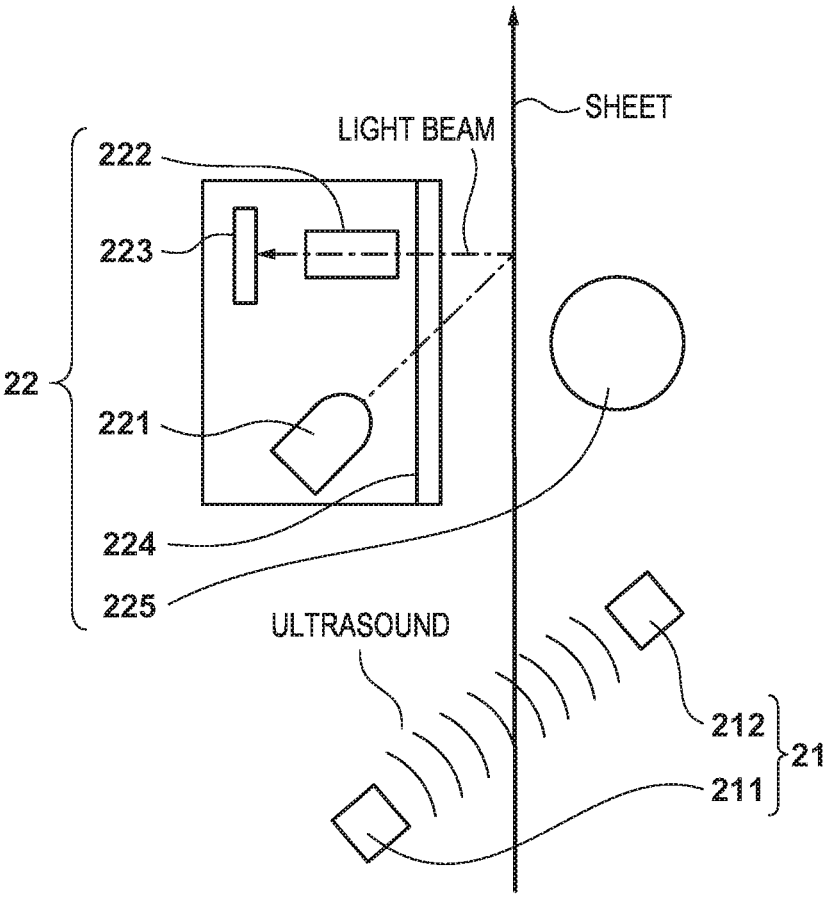
FIG. 3 is a diagram showing a configuration of a determination unit according to an embodiment.

FIG. 3 is a diagram showing a configuration of the determination unit 20. The determination unit 20 includes an ultrasonic detection unit 21 for detecting a characteristic value of a sheet using ultrasound, and a photodetection unit 22 for acquiring a characteristic value using light. Note that a configuration may be employed in which only one of the ultrasonic detection unit 21 and the photodetection unit 22 is used. The ultrasonic detection unit 21 has a transmitting unit 211 and a receiving unit 212 that are provided on opposite sides of the sheet conveyance path. When a sheet is present between the transmitting unit 211 and the receiving unit 212, the transmitting unit 211 transmits ultrasound, and the receiving unit 212 receives the ultrasound via the sheet. The receiving unit 212 outputs an electrical signal corresponding to the intensity (level) of the received ultrasound to the control unit 90. The control unit 90 can acquire a characteristic value related to the concentration and the thickness of the sheet based on, for example, the level of this electrical signal and the timing at which the signal level is maximum.

A light source 221 of the photodetection unit 22 emits light toward the sheet. A rod lens 222 guides reflected light, i.e., light reflected off the sheet surface, toward a light receiving unit 223. The light receiving unit 223 outputs an electrical signal corresponding to the intensity (or amount) of the received reflected light to the control unit 90. The control unit 90 can acquire a characteristic value related to the brightness and the lightness of the sheet, as well as the roughness of the sheet surface, based on the average value and the amount of change in this electrical signal. Note that a glass plate 224 is provided to prevent the sheet from coming into contact with the light source 221 and the rod lens 222. A roller 225 is provided such that the sheet surface is not distant from the light source 221 and rod lens 222 by a predetermined distance or more. Note that a configuration may be employed in which a plurality of light receiving units 223 is provided in the sheet conveyance direction and a direction perpendicular to the conveyance direction. By arranging the light receiving units 223 in a two-dimensional plane, the control unit 90 can acquire a characteristic value related to two-dimensional roughness of the surface of the sheet.

Figure 4:
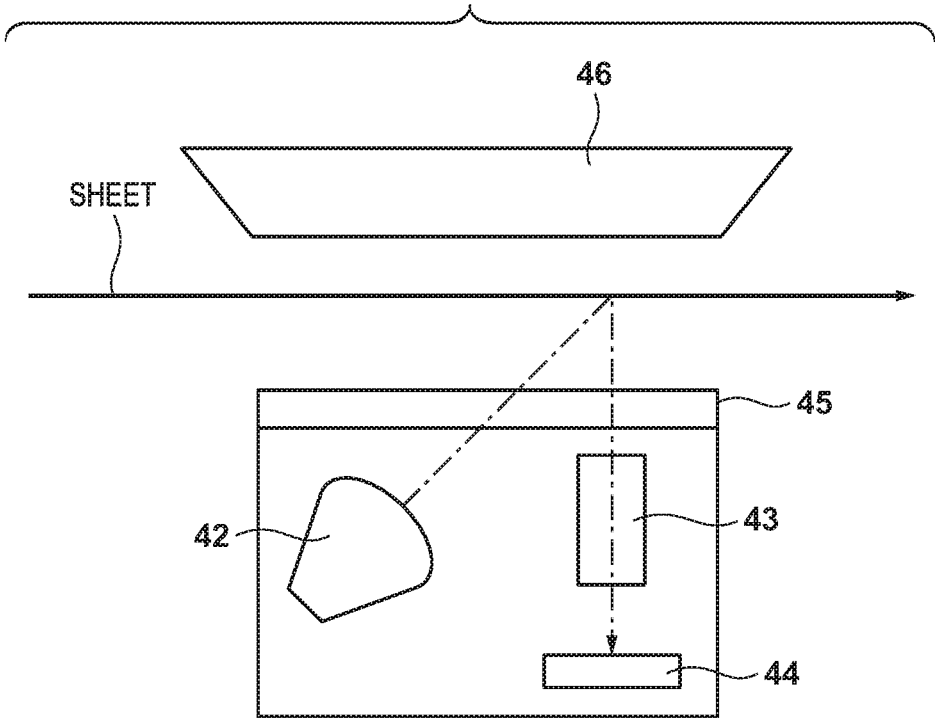
FIG. 4 is a diagram showing a configuration of a reading unit according to an embodiment.

FIG. 4 is a diagram showing a configuration of the reading unit 40. The light source 42 emits light toward a sheet. Note that the light source 42 emits light over the direction (width direction) perpendicular to the sheet conveyance direction. A rod lens array 43 has a structure in which a plurality of rod lenses are arranged in the width direction, and guides reflected light, i.e., light reflected off the sheet surface toward a light-receiving element array 44. The light-receiving element array 44 has a structure in which a plurality of light-receiving elements are arranged in the width direction, and each of the light-receiving elements outputs an electrical signal corresponding to the intensity (or amount) of received light to the control unit 90. The control unit 90 can acquire image information regarding the sheet surface based on this electrical signal. For example, if the light source 42 emits white light, and each light-receiving element outputs an electrical signal corresponding to the amount of received light, image information is brightness information (or lightness information) that indicates the brightness (or lightness) at each position on the sheet surface, that is, monochrome image information. For example, if the light source 42 emits light while temporally switching the light of the color between R (red), G (green), and B (blue) light, and each light-receiving element outputs an electrical signal corresponding to the amount of received light, image information is color image information. A glass plate 45 is provided to prevent the sheet from coming into contact with the light source 42 and the rod lens array 43. An opposing guide 46 is provided such that the sheet is not distant from the rod lens array 43 by a predetermined distance or more.

Figure 5:
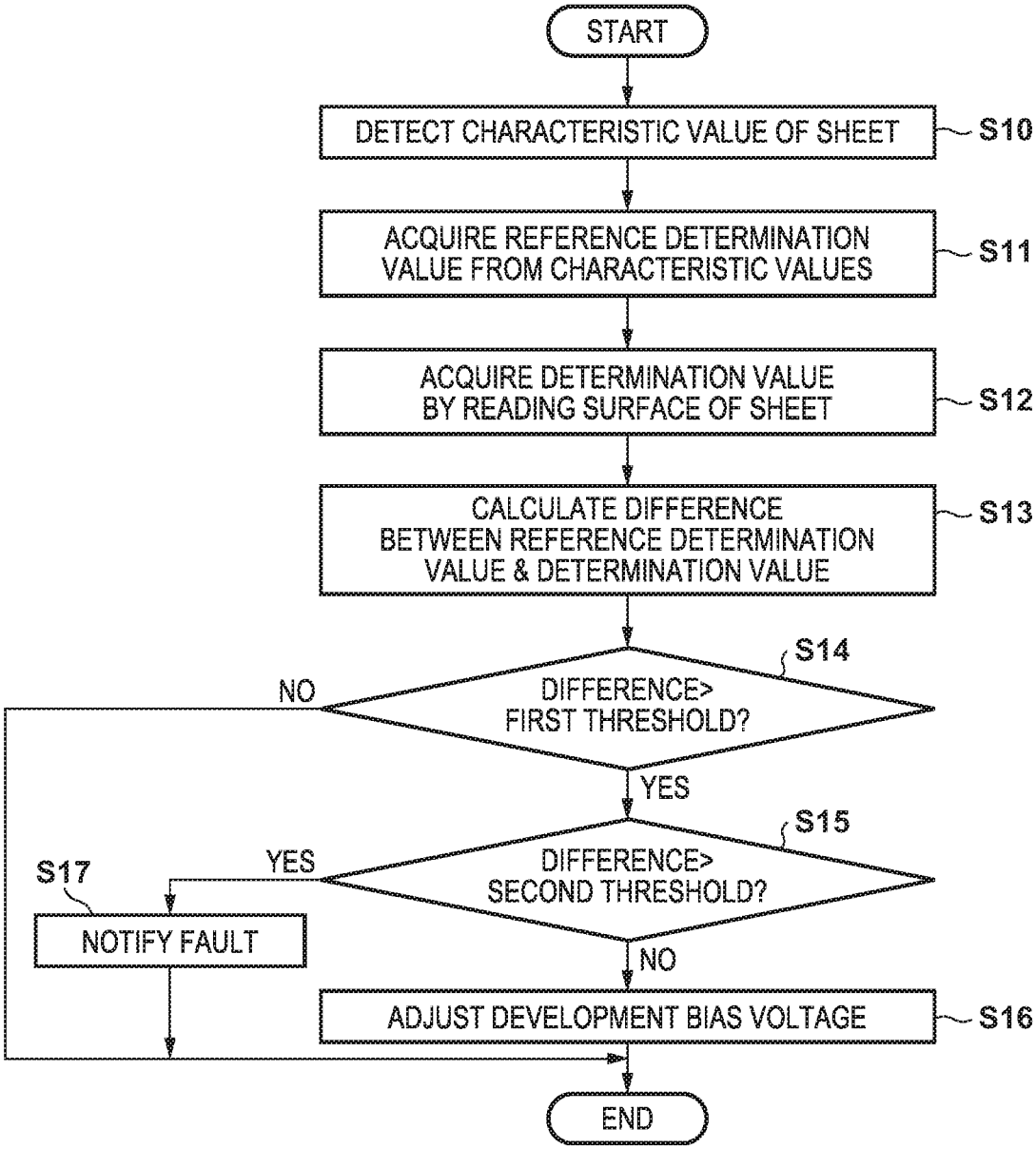
FIG. 5 is a flowchart showing image failure detection processing according to an embodiment.
Figures 6, 7:
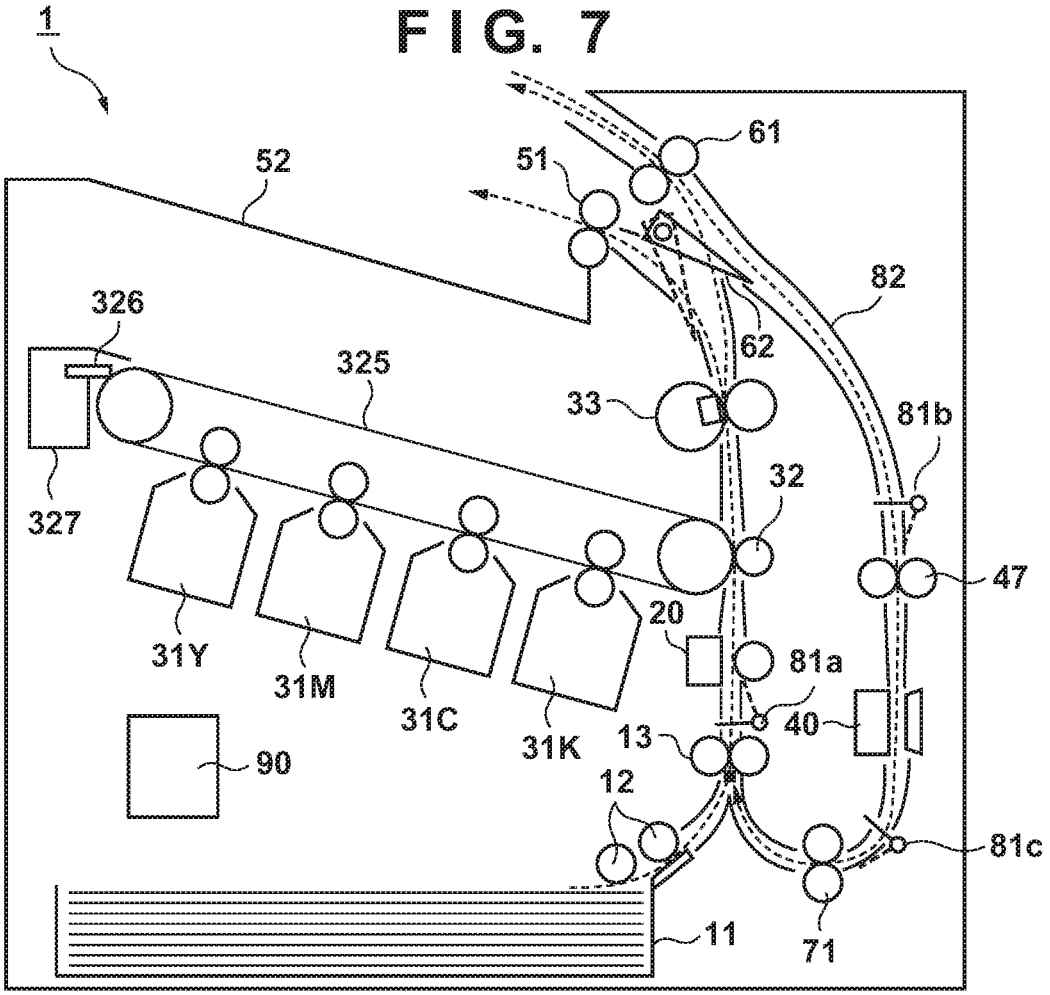
FIG. 6 is a diagram showing a conversion table according to an embodiment.
FIG. 7 is a diagram showing a configuration of an image forming apparatus according to an embodiment.

FIG. 5 is a flowchart showing determination processing for determining whether or not an image failure has occurred according to this embodiment. The control unit 90 conveys a sheet on which an image is to be formed toward the conveyance path. Upon this sheet reaching a position at which the determination unit 20 performs determination, in step S10, characteristic values of the sheet are acquired by the determination unit 20. In step S11, the control unit 90 acquires a reference determination value for whiteness of the sheet based on the acquired characteristic values of the sheet. Note that a conversion table (relationship information) that indicates a correspondence relationship between the characteristic values and the reference determination value is stored, in advance, in a memory (not shown) of the control unit 90. FIG. 6 shows an example of the conversion table. In this example, the conversion table shows the relationship between a combination of a change amount of reflected light intensity, which is a characteristic value detected by the photodetection unit 22, and an ultrasonic transmission signal intensity, which is a characteristic value detected by the ultrasonic detection unit 21, and the whiteness, which is the reference determination value. The higher the whiteness is, the brighter the sheet color is and the closer the color is to white. The change amount of reflected light intensity is the amount of change in the intensity of reflected light received by the light receiving unit 223, and corresponds to a change in the intensity of the electrical signal output by the light receiving unit 223. The ultrasonic transmission signal intensity is the intensity of ultrasound received by the receiving unit 212 via the sheet, and corresponds to the intensity of the electrical signal output by the receiving unit 223. In the conversion table in FIG. 6, these electrical signal intensities are normalized so as to take a value from 0 to 1. The conversion table is created based on the whiteness measured for various sheets and characteristic values of these sheets acquired using the determination unit 20.

The conversion table in FIG. 6 also indicates the type of sheet, which is determined based on the change amount of reflected light intensity and the ultrasonic transmission signal intensity. "Plain paper" refers to sheets that are mainly used to print documents. "Thick paper" refers to sheets that are thicker than "plain paper". "Thin paper" refers to sheets that are thinner than "plain paper". "Glossy paper" refers to sheets that have a thickness similar to that of "thick paper" and have been processed to have a flattened surface. "Recycled paper" refers to sheets that are made of a material with lower whiteness obtained by recycling used sheets.

Note that, when either one of the photodetection unit 22 and the ultrasonic detection unit 21 is used, the conversion table is created in accordance with the characteristic value that can be obtained by the detection unit to be used. The characteristic values to be used are not limited to those shown in FIG. 6 either, and any characteristic value that is correlated with the whiteness of sheets can be used. If the type of sheets to be used to print is explicitly designated in advance by a user, a whiteness that corresponds to the designated type of sheet, rather than the characteristic values detected by the determination unit 20 in step S10, can be used as the reference determination value. For example, if thick paper A has been designated as the type of sheet, in step S11, the control unit 90 determines that the reference determination value is 76, in accordance with the conversion table in FIG. 6. Note that the user can explicitly designate the type of sheet using an input unit (touch panel, etc.) (not shown) of the image forming apparatus 1, for example. As such, the input unit (touch panel, etc.) functions as an accepting unit for accepting the designation of the type of sheet by the user.

After the reference determination value has been acquired in step S11, an image is formed on the sheet by the image forming unit 31, and the image is fixed to the sheet by the fixing unit 33. Upon the sheet reaching a position at which the reading unit 40 reads the sheet, the control unit 90 causes the reading unit 40 to read a non-image area of the sheet, i.e., an area (margin area) of the sheet to which toner has not been transferred. Then, in step S12, the control unit 90 acquires the result of reading the non-image area of the sheet from the reading unit 40. The reading result is image information regarding the non-image area. The control unit 90 obtains the whiteness of the non-image area based on the brightness indicated by the image information, and uses the obtained whiteness as a determination value. Note that the method of obtaining the whiteness based on the brightness is preset in the control unit 90. In step S13, the control unit 90 obtains a difference between the reference determination value and the determination value.

In step S14, the control unit 90 determines whether or not the difference is greater than a first threshold. If the difference is less than or equal to the first threshold, the non-image area of the printed sheet is close to the reference determination value, and it can be determined that no toner is attached to the non-image area, or the amount of attached toner is in a permissible range even if the toner is attached. Accordingly, if the difference is less than or equal to the first threshold, the control unit 90 ends processing in FIG. 5. On the other hand, if the difference is greater than the first threshold, the control unit 90 determines that fog has occurred. In this case, in step S15, the control unit 90 determines whether or not the difference is greater than a second threshold. Note that the second threshold is greater than the first threshold. If the difference is less than or equal to the second threshold, in step S16, the control unit 90 adjusts image forming conditions so as to suppress the fog. In this embodiment, development conditions, e.g., a development bias voltage, are adjusted to suppress the fog. However, any other image forming conditions may be adjusted. On the other hand, if the difference is greater than the second threshold, the control unit 90 determines that the fog cannot be suppressed by adjusting the development bias voltage, and in step S17, the control unit 90 notifies the user of a fault of the development unit.

The fault notification can be given by displaying the notification on a display unit (not shown) of the image forming apparatus 1, outputting a warning sound or voice from a speaker (not shown), or transmitting a message to a predetermined device via a network. The image forming apparatus 1 may also perform detailed fault diagnosis on the development unit along with or instead of giving the fault notification. Note that the content of the fault diagnosis is determined and set to the control unit 90 in advance. In FIG. 5, it is determined for each single sheet that fog has occurred if the difference exceeds the first threshold. However, a configuration may be employed in which it is determined that fog has occurred if the number of times that the difference exceeds the first threshold reaches a predetermined number of times. The same applies to the comparison between the difference and the second threshold.

As described above, in this embodiment, a sheet does not need to be read by the reading unit 40 before printing, and the print time for the sheet can be restrained from lengthening for image failure detection.

Note that, in this embodiment, the determination unit 20 detects characteristic values of a sheet before an image is formed on the sheet. However, in the case of using ultrasound, a configuration may be employed in which a characteristic value of a sheet is detected after an image has been formed on the sheet. In step S14 in the flowchart in FIG. 5, it is determined that an image failure has occurred if the difference is greater than the first threshold, and it is determined that an image failure has not occurred if the difference is less than or equal to the first threshold. However, a configuration may alternatively be employed in which, in step S14, it is determined that an image failure has occurred if the difference is greater than or equal to the first threshold, and it is determined that an image failure has not occurred if the difference is less than the first threshold. That is to say, whether processing to be performed when the difference is equal to the first threshold is the same as that performed when the difference is greater than the first threshold or that performed when the difference is less than the first threshold is a matter of design, and either may be employed. The same applies to the other thresholds.

Second Embodiment

Next, the second embodiment will be described, mainly regarding differences from the first embodiment. FIG. 7 is a diagram showing a configuration of an image forming apparatus according to this embodiment. Note that the same reference numerals are assigned to the same constituent elements as those described in FIG. 1, and a description thereof will be omitted. In this embodiment, the image forming apparatus 1 has four image forming units 31Y, 31M, 31C, and 31K. Note that the configuration of the image forming units are basically the same as that in FIG. 2. Note that, in FIG. 7, a photoreceptor drum 311 of each image forming unit is driven to rotate in a clockwise direction in the diagram. The image forming units 31Y, 31M, 31C, and 31K form yellow, magenta, cyan, and black toner images, respectively, on the photoreceptor drum 311, and transfer these toner images to an intermediate transfer belt 325. Note that the intermediate transfer belt 325 is driven to rotate in a counterclockwise direction in the diagram when an image is formed. As a result of the image forming units transferring the toner images in an overlapping manner to the intermediate transfer belt 325, a full-color toner image is formed on the intermediate transfer belt 325. The toner image transferred to the intermediate transfer belt 325 is conveyed to a position opposing the transfer roller 32 due to the rotation of the intermediate transfer belt 325, and is transferred to the sheet here. Note that toner that has not been transferred to the sheet but remains on the intermediate transfer belt 325 is collected into a box 327 by a cleaning blade 326.

The image forming apparatus 1 according to this embodiment has a circulative conveyance path 82 for forming an image on both faces of a sheet. In the case of forming an image on only one face of a sheet, after a toner image has been fixed, the sheet is discharged to the tray 52 by the discharge roller 51. Note that, at this time, a flapper 62 is set in a direction in which the flapper 62 guides the sheet toward the discharge roller 51. On the other hand, in the case of forming images on both faces of a sheet, after a toner image transferred to one face has been fixed, the sheet is conveyed toward an inverting roller 61. Note that, at this time, a flapper 62 is set in a direction in which the flapper 62 guides the sheet toward the inverting roller 61. Upon a trailing end of the sheet passing over a branch position toward the circulative conveyance path 82, the inverting roller 61 is rotated in a direction opposite to the direction in which the sheet has been conveyed thus far. Thus, the sheet is conveyed toward the circulative conveyance path 82. Note that, at this time, the flapper 62 is set in a direction in which the flapper 62 guides the sheet toward the circulative conveyance path 82. Then, the sheet is conveyed again to an image forming position, i.e., a position opposing the transfer roller 32 by the rollers 47, 71, and 13, and a toner image is transferred to the other face of the sheet. In this embodiment as well, sensors 81*a*, 81*b*, and 81*c* for detecting a sheet are provided along the conveyance path. In this embodiment, the reading unit 40 is provided in the circulative conveyance path 82. Note that the configuration for conveying a sheet toward the circulative conveyance path 82 is not limited to the configuration in FIG. 7. For example, a configuration may alternatively be employed in which the discharge roller 51 is configured to be able to rotate in both directions, and a sheet is conveyed toward the circulative conveyance path 82 by rotating the discharge roller 51 in a reverse direction.

Figure 8:
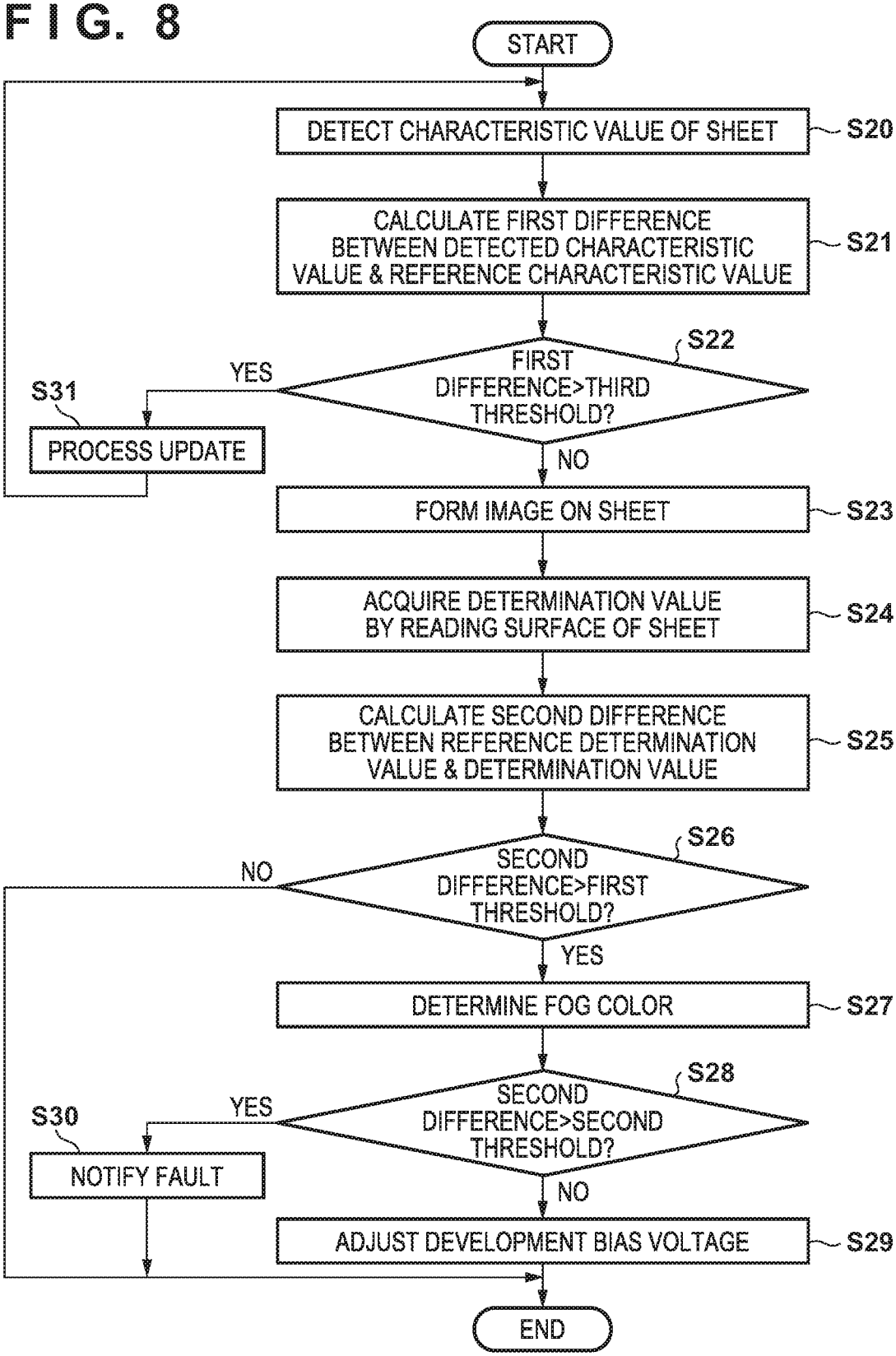
FIG. 8 is a flowchart showing image failure detection processing according to an embodiment.

FIG. 8 is a flowchart of image failure detection processing according to this embodiment. The control unit 90 conveys a sheet on which an image is to be formed toward the conveyance path. Upon this sheet reaching a determination position for the determination unit 20, in step S20, a characteristic value of the sheet is acquired by the determination unit 20. In step S21, the control unit 90 obtains a first difference between the acquired characteristic value and a reference characteristic value held by the control unit 90. Although the details will be described later, the reference characteristic value is not updated when the first difference is less than or equal to a third threshold, which is a predetermined value. If the first difference is greater than the third threshold, the reference characteristic value is updated with the characteristic value detected by the determination unit 20 at this time. Since the characteristic value indicates a characteristic of a sheet, this corresponds to not updating the reference characteristic value while sheets with a similar characteristic are printed, and updating the reference characteristic value if the characteristic of sheets to be printed changes by a predetermined reference value (third threshold) or more.

If the first difference is less than or equal to the third threshold, in step S23, the control unit 90 forms an image on the sheet. Then, the control unit 90 conveys the sheet to the circulative conveyance path 82. In step S24, the control unit 90 reads the non-image area of the sheet and acquires a determination value. In step S25, the control unit 90 obtains a second difference between a determination value and the reference determination value held by the control unit 90. Note that, in this embodiment, the determination value and the reference determination value are values that indicate the brightness of the base of the sheet. However, the determination value and the reference determination value may also indicate whiteness, similarly to the first embodiment. Furthermore, the determination value and the reference determination value may alternatively be color values of any color space, or may indicate brightness. Although the details will be described later, the reference determination value represents the lightness of the base of the sheet from which the reference characteristic value has been acquired. Accordingly, the reference determination value is updated when the reference characteristic value is updated. Note that, to determine a fog color, in step S24, the control unit 90 also reads a color value of the non-image area of the sheet, as will be described later. When updating the reference characteristic value, the control unit 90 stores, as a reference color value, a base color value of the sheet from which the reference characteristic value has been acquired.

In step S26, the control unit 90 determines whether or not the second difference is greater than the first threshold. If the second difference is less than or equal to the first threshold, the determination value of the non-image area of the printed sheet is close to the reference determination value, and it can be determined that no toner is attached to the non-image area, or the amount of attached toner is in a permissible range even if toner is attached thereto. Accordingly, if the second difference is less than or equal to the first threshold, the control unit 90 ends processing in FIG. 8. On the other hand, if the second difference is greater than the first threshold, the control unit 90 determines that fog has occurred. In this case, in step S27, the control unit 90 determines the fog color, i.e., the color of the toner attached to the non-image area. This determination can be performed based on the color value that has been acquired together with the determination value in step S24. More specifically, since the reference color value represents the base color of the sheet, the difference between the color value acquired in step S24 and the reference color value indicates the toner color with the influence of the base color of the sheet suppressed. Accordingly, the control unit 90 can determine the fog color based on this difference. Next, in step S28, the control unit 90 determines whether or not the second difference is greater than the second threshold. Note that the second threshold is greater than the first threshold. If the second difference is less than or equal to the second threshold, in step S29, the control unit 90 adjusts the development bias voltage at a development unit that corresponds to the fog color, in order to suppress the fog. On the other hand, if the second difference is greater than the second threshold, the control unit 90 determines that the fog cannot be suppressed by adjusting the development bias voltage, and in step S30, the control unit 90 notifies the user of a fault of the development unit that corresponds to the fog color.

On the other hand, if, in step S22, the first difference is greater than the third threshold, in step S31, the control unit 90 performs processing to update the reference characteristic value, the reference determination value, and the reference color value. In this case, the control unit 90 sets the characteristic value detected in step S20 as the reference characteristic value. Also, the control unit 90 conveys the sheet toward the circulative conveyance path 82 without forming an image on the sheet. Note that, to prevent the toner from being attached to the sheet, the control unit 90 sets the developing roller 314 in the separate state. The reading unit 40 reads the lightness and the color value of the surface (base) of the sheet that is being conveyed through the circulative conveyance path 82. The control unit 90 then sets the read lightness of the sheet as the reference determination value. The control unit 90 also sets the read color value of the sheet as the reference color value. After performing the updating processing, the control unit 90 conveys the sheet again to the position opposing the determination unit 20 and performs determination processing. Note that when the sheet is conveyed again to the position opposing the determination unit 20 as a result of being conveyed through the circulative conveyance path 82, the face from which the determination unit 20 acquires the characteristic of the sheet is opposite to the face from which the determination unit 20 has first acquired the characteristic of the sheet. Accordingly, after the sheet has been read by the reading unit 40, the control unit 90 conveys the sheet again toward the circulative conveyance path 82 without forming an image on the sheet.

Then, the control unit 90 repeats the processing from step S20. Note that a configuration may be employed in which, if there is a not significant difference in color and characteristics between the two sides of the sheets, processing in step S20 is started as-is after the base color of the sheet has been read by the reading unit 40.

The image forming apparatus 1 according to this embodiment has only one cassette 11 for storing sheets. However, image forming apparatuses 1 are commonly used that have a plurality of cassettes 11 and selectively feed sheets from the plurality of cassettes 11. Usually, different types of sheets are contained in respective cassettes 11. In this case, the control unit 90 manages the reference characteristic value, and the reference determination value and the reference color value that are associated with the reference characteristic value, for each of the cassettes 11. If the characteristic value of the sheet on which an image is to be formed significantly changes from the reference characteristic value of the cassette 11 in which the sheet has been stored by the third threshold or more, the control unit 90 updates the reference characteristic value, the reference determination value, and the reference color value of this cassette 11. Fog detection is also performed based on the reference determination value of the cassette 11 from which the sheet has been fed.

Note that a configuration may also be employed in which the reference characteristic value, the reference determination value, and the reference color value are updated not only when the first difference is greater than the third threshold, but also when any of the development units is replaced or fixed, or every time a predetermined number of sheets are printed.

As described above, in this embodiment, fog determination is performed while dynamically updating the reference determination value, and thus, fog detection accuracy can be increased. However, the reference determination value is acquired only when a predetermined condition is met, e.g., when the characteristic value has significantly changed by the third threshold or more. Therefore, the time required for printing can be prevented from lengthening as a whole.

Note that, although the above embodiment has given a description while taking fog detection as an example, the present invention is applicable to any image failure that can be detected by comparing the base color of a sheet before printing and the color of the non-image area of the printed sheet. In this embodiment, the reading unit 40 reads the surface of the sheet that is being conveyed through the conveyance path between the fixing unit 33 and the discharge port for discharging the sheet from the image forming apparatus. However, in the case of an image forming apparatus that has a circulative conveyance path 82, as in the case of the image forming apparatus in the second embodiment, the reading unit 40 in the first embodiment can also be provided in the circulative conveyance path 82.

A configuration can also be employed in which the user makes a setting as to whether or not to perform image failure determination processing (FIGS. 5 and 8). For example, the user can make a setting as to whether or not to perform image failure determination processing using an input unit (touch panel, etc.) (not shown) of the image forming apparatus 1. As such, the input unit (touch panel, etc.) functions as a setting unit for making a setting as to whether or not to perform image failure determination processing. The control unit performs determination processing if the setting unit has made a setting to perform image failure determination processing, and does not perform determination processing in other cases.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-134014, filed on Jul. 19, 2019 and Japanese Patent Application No. 2019-226807, filed on Dec. 16, 2019, which are hereby incorporated by reference herein in their entirety.

What is claimed is:

1. An image forming apparatus comprising:

an image forming unit configured to form an image on a sheet;

a detection unit configured to detect a characteristic value of the sheet;

a reading unit configured to optically read the sheet; and a control unit configured to perform determination processing for determining whether or not an image failure has occurred by comparing a determination value acquired by causing the reading unit to read a non-image area of the sheet after an image has been formed on the sheet with a reference determination value that is based on the characteristic value detected by the detection unit, wherein the control unit is further configured to hold a reference characteristic value and the reference determination value associated with the reference characteristic value, and perform the determination processing by using the reference determination value associated with the reference characteristic value if a difference between the characteristic value detected by the detection unit and the reference characteristic value is less than a predetermined value.

2. The image forming apparatus according to claim 1, wherein the control unit is further configured to hold relationship information indicating a correspondence relationship between the characteristic value and the reference determination value, and perform the determination processing by using the reference determination value corresponding to the characteristic value detected by the detection unit and indicated by the relationship information.

3. The image forming apparatus according to claim 1, wherein the image forming unit includes a transfer unit configured to transfer an image to the sheet, and a fixing unit configured to fix, to the sheet, the image transferred to the sheet, and the reading unit is further configured to read the non-image area of the sheet that is being conveyed through a conveyance path between the fixing unit and a discharge port for discharging the sheet from the image forming apparatus.

4. The image forming apparatus according to claim 1, further comprising a circulative conveyance path for conveying, again, the sheet on which an image has been formed by the image forming unit to a position at which an image is to be formed on the sheet by the image forming unit, wherein the reading unit is further configured to read the non-image area of the sheet in the circulative conveyance path.

5. The image forming apparatus according to claim 4, wherein the control unit is further configured to, if the difference between the characteristic value detected by the detection unit and the reference characteristic value is greater than the predetermined value, perform updating processing for updating the reference characteristic value with the characteristic value detected by the detection unit, conveying the sheet to the circulative conveyance path without forming an image on the sheet and causing the reading unit to read a surface of the sheet, and updating the reference determination value with the determination value acquired by the reading unit reading the surface of the sheet.

6. The image forming apparatus according to claim 5, wherein the control unit is further configured to perform the determination processing on the sheet after performing the updating processing.

7. The image forming apparatus according to claim 1, further comprising a plurality of sheet storing units for storing the sheet, wherein the control unit holds the reference characteristic value and the reference determination value associated with the reference characteristic value for each of the plurality of sheet storing units.

8. The image forming apparatus according to claim 7, wherein the control unit is further configured to, if a difference between the reference characteristic value for a sheet storing unit in which the sheet on which an image is to be formed has been stored, of the plurality of sheet storing units, and the characteristic value detected by the detection unit is less than the predetermined value, perform the determination processing using the reference determination value associated with the reference characteristic value for the sheet storing unit.

9. The image forming apparatus according to claim 7, further comprising a circulative conveyance path for conveying, again, the sheet on which an image has been formed by the image forming unit to a position at which an image is to be formed on the sheet by the image forming unit, wherein the reading unit is further configured to read the non-image area of the sheet in the circulative conveyance path, and wherein the control unit is further configured to, if a difference between the reference characteristic value for a sheet storing unit in which the sheet on which an image is to be formed has been stored, of the plurality of sheet storing units, and the characteristic value detected by the detection unit is greater than the predetermined value, perform updating processing for updating the reference characteristic value for the sheet storing unit with the characteristic value detected by the detection unit, conveying the sheet to the circulative conveyance path without forming an image on the sheet and causing the reading unit to read a surface of the sheet, and updating the reference determination value associated with the reference characteristic value for the sheet storing unit with the determination value acquired by the reading unit reading the surface of the sheet.

10. The image forming apparatus according to claim 1, wherein the detection unit is further configured to detect the characteristic value of the sheet before an image is formed on the sheet.

11. The image forming apparatus according to claim 1, wherein the detection unit is further configured to detect the characteristic value by emitting light toward the sheet and receiving reflected light from the sheet, and/or transmitting ultrasound and receiving the ultrasound via the sheet.

12. The image forming apparatus according to claim 1, wherein the control unit is further configured to control an image forming condition used by the image forming unit if it is determined that the image failure has occurred.

13. The image forming apparatus according to claim 12, wherein the image forming unit forms an image on an image carrier by developing an electrostatic latent image formed on the image carrier using toner, and the image forming condition is a condition of the development.

14. The image forming apparatus according to claim 1, wherein, in the determination processing, if the number of times that a difference between the determination value and the reference determination value is greater than a first threshold reaches a predetermined number of times, the control unit determines that the image failure has occurred.

15. The image forming apparatus according to claim 14, wherein, in the determination processing, if the number of times that the difference between the determination value and the reference determination value is greater than a second threshold reaches a predetermined number of times, the control unit gives a fault notification, and the second threshold is greater than the first threshold.

16. The image forming apparatus according to claim 1, wherein the determination value is a value indicating whiteness.

17. The image forming apparatus according to claim 1, wherein the determination value is a value indicating lightness.

18. The image forming apparatus according to claim 17, wherein the image forming unit is configured to form an image on the sheet using toner of a plurality of colors, the reading unit is further configured to read a color value of the sheet, and the control unit is further configured to, if it is determined that the image failure has occurred, determine a color of toner that has caused the image failure, based on a difference between the color value read by the reading unit and a base color value of the sheet.

19. The image forming apparatus according to claim 1, further comprising a setting unit configured to make a setting as to whether or not to perform the determination processing, wherein the control unit is further configured to perform the determination processing if the setting unit has made a setting to perform the determination processing.

* * * * *